US006532876B1

(12) United States Patent
Ramirez et al.

(10) Patent No.: US 6,532,876 B1
(45) Date of Patent: Mar. 18, 2003

(54) GUN CARTRIDGE

(76) Inventors: Henry Gene Ramirez, 971 Temple Dr., Pacheco, CA (US) 94553; Gabriel A. Ramirez, 971 Temple Dr., Pacheco, CA (US) 94553

( * ) Notice: Subject to any disclaimer, the term of this patent is extended or adjusted under 35 U.S.C. 154(b) by 0 days.

(21) Appl. No.: 09/413,828

(22) Filed: Oct. 6, 1999

(51) Int. Cl.[7] ..... F42B 7/02

(52) U.S. Cl. ..... 102/430; 102/439; 102/464

(58) Field of Search ..... 102/430, 439, 102/464

(56) References Cited

U.S. PATENT DOCUMENTS

| | | | | | |
|---|---|---|---|---|---|
| 2,269,316 | A | * | 1/1942 | O'Neil | 102/16 |
| 5,033,386 | A | * | 7/1991 | Vatsvog | 102/467 |
| 5,463,959 | A | * | 11/1995 | Kramer | 102/464 |
| 5,970,879 | A | * | 10/1999 | Jamison | 102/470 |

OTHER PUBLICATIONS

Frank C. Barnes, Cartridges of the World (p. 205); Follett Publishing Company 1965.*

A–Square Hand Loader Book vol. I (1996)– Drawing of .577 Tyrannosaur Cartridge.

Rifle Magazine (1999)—Advertisement for the 500 Whisper Cartridge.

Cartridges of the World by Frank C. Barnes (5th Edition), pp. 130–132.

* cited by examiner

*Primary Examiner*—Charles T. Jordan
*Assistant Examiner*—Kimberly S. Smith
(74) *Attorney, Agent, or Firm*—Mitchell S. Rosenfeld

(57) ABSTRACT

The present invention provides a method of determining the efficiency of a gun cartridge by determining the water weight volume of the cartridge; determining the bore diameter of the gun barrel; determining the weight of the bullet; and calculating the efficiency rating of the cartridge by multiplying the water weight volume by the bore diameter and dividing by the bullet weight. The efficiency rating is optimal between 110 and 145 when the water weight volume is determined in grains, the bore diameter is determined in thousandths of inches and the bullet weight is determined in grains. One such 50 caliber gun cartridge has a casing diameter of approximately 0.688 inches and neck portion which accepts a bullet having a bore diameter of approximately 0.510 inches. The case has a length ranging from 1.75 inches to 2.5 inches measured from the primer to the mouth of the neck.

8 Claims, 1 Drawing Sheet

GUN CARTRIDGE

FIELD OF THE INVENTION

The present invention relates to a gun cartridge, more particularly, a series of and method of making efficient, high velocity gun cartridges for a 50 caliber gun.

BACKGROUND OF THE INVENTION

The 50 caliber Browning Machine Gun (BMG) was developed in 1917 from John Browning's design. Its intended use was as an anti-aircraft battery and anti-tank weapon. It was not intended to be used as an anti-personnel weapon. It remains the largest and most heavily used machine gun today.

The original loading was an 800 grain bullet at 2650 feet per second velocity (fps) out of a 46" barrel. It was later loaded with a 900 grain bullet at 2500 fps. Currently the 50 BMG is loaded with a 650 grain bullet at 3000 fps. The bullets may be AP (armor piercing), API (armor piercing incendiary), APT (armor piercing tracer), ball (steel-cored) or FMJT (full metal jacket tracer). It is designed to be effective past 2000 meters or 2500 yards.

The 50 BMG is no longer used as an anti-aircraft battery. Today it is used for defense on armored personnel carriers, the Bradley fighting machine, and stationary mounted to provide cover for troops. Its long-range capability at 2000+ yards makes it valuable for extreme long-range sniping use when chambered in bolt-action rifles designed around the cartridge. These bolt-action rifles require a special custom-built action to accommodate the large 50 BMG cartridge.

The 50 BMG began to gain popularity among civilians as a 1000 yard target rifle. To feed the public's interest in the cartridge gun makers developed more sophisticated and more accurate target rifles around this cartridge. Many gun manufacturers began putting on the market their own designs for 50 caliber target rifles, most of which were single-shot. As the popularity of the 50 caliber grew among civilians, the military became interested in it as a long-range sniper cartridge. Now almost all 1000 yard match records are held by the 50 caliber.

Law enforcement and the military have found that when the 50 BMG is adapted to shoulder-held weapons it is far superior to any other shoulder-held weapon in use today. Its large projectile (650 and 750 grain FMJ, of which the 650 grain is most popular) at high velocity translates into awesome power for the shooter.

The 50 BMG suffers from a number of disadvantages including extremely large muzzle flash, very loud report, short barrel life due to throat erosion, and extremely large rifles necessary to accommodate the cartridge. As a machine gun (M2 Browning) the 50 caliber weighs 150+ pounds, and requires 2 to 3 men to set it up. When chambered in a bolt-action sniping type weapon its disadvantages sometimes outweigh its advantages. Also tremendous muzzle flash is a problem. When shooting in the evening or at night the muzzle flash can be easily seen for more than three miles. When shooting low to the ground or from a prone position it kicks up large clouds of dust. This is mainly due to the huge case capacity (overbore) and to the shortening of the barrel, which was necessary to adapt the cartridge to a sniping style rifle. With the shortened barrel a large drop in muzzle velocity occurred. Velocity drops an average of 300 fps.

The 50 caliber has always been valued by the military as an effective and hard-hitting cartridge. It has been used as a platoon support weapon but not as a squad support weapon because of its weight and bulk. Even in a sniping rifle design it is still too cumbersome to carry in many cases.

A significant problem most civilians have with the 50 caliber target rifle is its expense as the guns range from $4000 to $10,000. The ammunition is very expensive, and the components with which to reload for such a rifle are very expensive. The loading press is a special press that is much larger than a standard loading press and about 4 times the cost. The loading dies are larger diameter dies, almost twice the size of standard loading dies, and 10 times the price. Primers for the 50 caliber BMG are a unique design and only fit the 50 BMG. These primers vary from .50 to $1 each, depending upon the source.

Also the 50 BMG is what is classified as an inefficient cartridge. Inefficient cartridges, whether they be sporting or military design, burn a more than average amount of powder to gain a small increase in velocity and ft-lbs. of muzzle energy. To illustrate inefficiency in more understandable terms, a helpful example is a trawler that can be moved across water at 9 knots using two 120 horsepower engines. To increase the speed at which the trawler moves across the water to 10 knots would require two 200 horsepower engines. This is a vast increase in power and fuel consumption for a one knot gain in speed. Although the 50 BMG cartridge was designed to be fired in a Browning machine gun with a 46" barrel, even with that lengthy barrel a great deal of powder remains unburned. This unburned powder is due to the fact that there was much more powder in the case than the bore can consume efficiently, which was also the reason for the large muzzle flash.

Another 50 caliber cartridge is the 500 Whisper. The 500 Whisper was built on the shortened 460 Weatherby case, the same as the alternate embodiment of the present invention. The difference between the two is that the 500 Whisper was built on a shortened 460 Weatherby case, 2.5" overall case length. This cartridge was intended as a subsonic round. Subsonic means velocities at 1100 fps or slower. The cartridge uses a 750 grain bullet and was intended for long-range sniping use with no sound. The 500 Whisper was built on a 24" barrel rifle.

The 500 Whisper suffers from too small of a case capacity which results in an inefficient cartridge. The small capacity is a result of the 500 Whisper being designed to be subsonic thus it is only useful as a subsonic sniping round. It is not useful for a squad, infantry or attack rifle. Additionally, the Whisper 500 was designed for firing in an urban setting so the marksman could remain undetected and still penetrate a kevlar helmet at 600 yards. The gun cartridges of the present invention are more versatile and capable of much higher velocity and penetration of a kevlar helmet at much greater ranges (in excess of 2000 yards).

Yet another 50 caliber cartridge is the 50 Caliber Spotter Round. This was built on a shortened 50 caliber BMG case. The case had an overall length of 2". It was intended as a spotter round in tank artillery and occasionally used in machine guns in aircraft. It came into use during WWII and has not been used since. This cartridge uses a shortened 50 BMG case but the rim size of 0.804 inches is too large to fit any shoulder held weapons. Morever, it will only fit guns already fitted for the 50 BMG.

There are a number of terms associated with guns, bullets and cartridges that are defined and used herein as follows:

Barrel Life (Throat Erosion): The condition of overheating and eroding the throat area (the part of the chamber where the bullet contacts the rifling) of a rifle barrel by large amounts of slow burning powder down a relatively small bore.

Cannelure: Circumferential groove(s) around a bullet or cartridge case. Used for identification, to hold lubricant, or to crimp case into.

Capacity: Volume; ability to contain a substance

Disintegrating bullet: A bullet made of a carbon powder pressed together under high pressure so the bullet fragments are turned back to powder when hitting extremely hard substances, such as steel or concrete walls.

Efficient: Marked by an ability to use the most effective and least wasteful means of accomplishing a purpose or doing a task.

Efficiency: Performance of a task with little or no wasted effort; capability to produce desired results with a minimum expenditure of energy.

Force Multiplier: A means of increasing the firepower of an individual, a squad (a seven to twelve man team), a platoon (four to five squads), or a company (four to five platoons) without adding additional personnel or equipment.

Inefficient: Wasteful of energy in performing a task; or underpowered and therefor incapable of performing a task to optimal standards.

Overbore Capacity: Any cartridge that has a volume too large in relation to bore diameter with normally available powders.

Sniper: One that fires at exposed men or equipment of an enemy at a long distance.

SUMMARY OF THE INVENTION

The cartridges of the present invention can be made on much shorter barrels with much less or virtually no muzzle flash, and shorter actions, which translates into a much more easily controlled weapon, and one that can be carried and shouldered by an individual. Thus, the cartridges of the present invention allow rifles to be designed that are much less cumbersome than the 50 BMG, and still allow second and third shot capability without losing the point of aim.

The present invention provides a method of determining the efficiency of a gun cartridge by determining the water weight volume of the cartridge; determining the bore diameter of the gun barrel; determining the weight of the bullet; and calculating the efficiency rating of the cartridge by multiplying the water weight volume by the bore diameter and dividing by the bullet weight. The efficiency rating is optimal between 110 and 145 when the water weight volume is determined in grains, the bore diameter is determined in thousandths of inches and the bullet weight is determined in grains. There are 7000 grains in one pound. One such 50 caliber gun cartridge has a casing diameter of approximately 0.688 inches and neck portion which accepts a bullet having a bore diameter of approximately 0.510 inches. The case has a preferred length ranging from 1.75 inches to 2.4 inches measured from the primer to the mouth of the neck.

The present invention has other objects and advantages which are set forth in the description of the Description of the Preferred Embodiments. The features and advantages described in the specification, however, are not all inclusive, and particularly, many additional features and advantages will be apparent to one of ordinary skill in the art in view of the drawings, specification, and claims herein.

DESCRIPTION OF THE PREFERRED EMBODIMENTS

Figure 1:
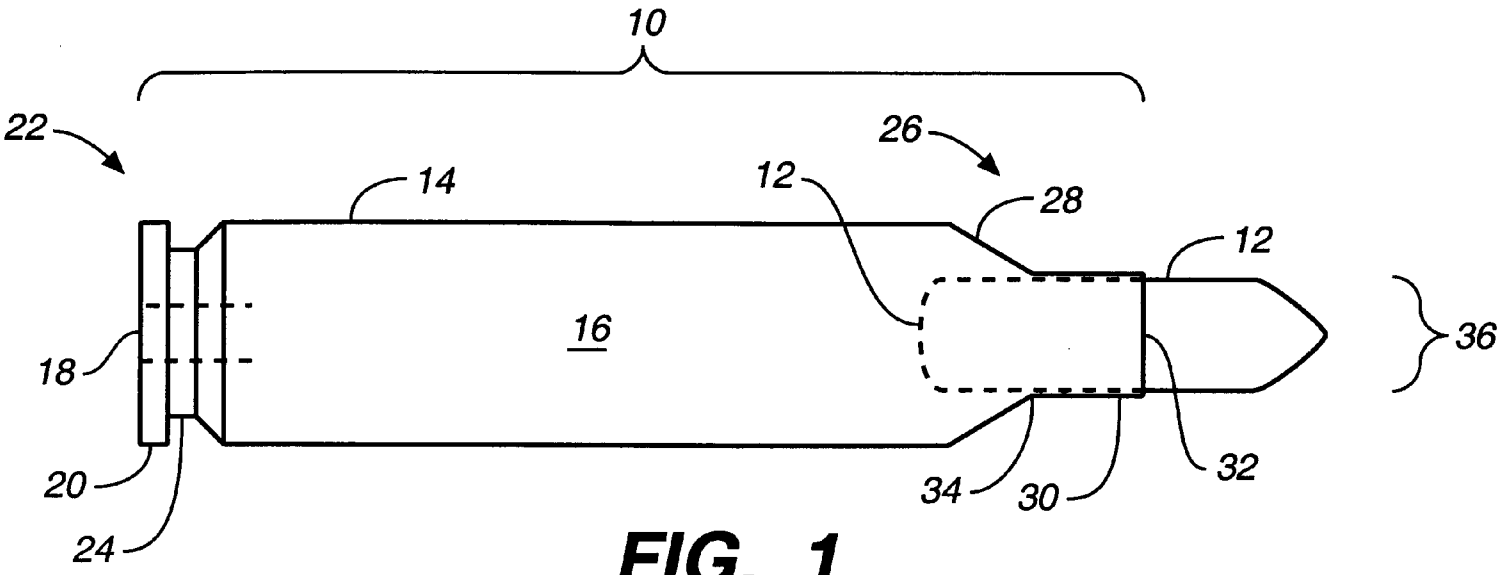
FIG. 1 is a side view of the gun cartridge of the present invention.

The present invention is an efficient gun cartridge and a method of manufacturing efficient gun cartridges.

Gun manufacturers, in an effort to make the 50 BMG more manageable for target shooters and military sniping use, have shortened the barrel from 46" to 28". The shorter barrel resulted in lowered muzzle velocity of 2500–2700 fps. The present invention utilizes a much smaller case, with a more efficient powder charge, in order to get the same velocity as the shortened barrel 50 BMG. This is accomplished by utilizing a particular ratio between the case capacity, bullet weight and bore diameter of the gun barrel. Thus, applying the efficiency ratio of the present invention, at least 120 grains less powder can be utilized with the same bullet (650 grain FMJ) in a smaller case and still produce the same muzzle velocity as the full 50 BMG, with much longer barrel life and much less muzzle flash.

One goal of the present invention is to provide a cartridge that would fit into a bolt action rifle magazine. For example a cartridge that will function through a magnum length Mauser style rifle, commonly in use today as a hunting or target rifle and the same style rifle that was used during the first and second World Wars. The cartridge is designed to feed through the action and feed into the magazine without the large cumbersome actions that the 50 BMG cartridge requires and still maintain the ballistics of the 50 BMG in a 26–28" barrel. The cartridge is designed so that the head space will be on the shoulder and not the rim of the cartridge or the belt as in a belted cartridge. The cartridge is designed to have very little muzzle flash because of the greatly reduced powder capacity, compared to the 50 caliber machine gun cartridge that is in use today. Because the powder used is about half the amount of the 50 BMG, barrel life would triple because there would be very little throat erosion. Since most of the powder is being burned inside the barrel, there would be very little muzzle flash, especially in the shorter cartridges.

The preferred cartridges are made with a 0.688 inch diameter case and a maximum overall case length of 2.4 inches. The result is a cartridge with the largest diameter case that is short enough to feed through a standard magnum length action and fit a standard magnum bolt face, and still have the capability of holding a minimum of 150 grains of powder. The bullet, from the cannelure forward (which is the part of the bullet that protrudes from the case), will always be 1½" long. This remains a constant.

All of the cartridge embodiments described below, are constructed by applying the efficiency ratio of the present invention. Based on a desired bullet weight and cartridge length, the bore diameter is then determined.

FIG. 1 depicts a cartridge 10 for propelling bullet 12. Cartridge 10 is constructed of casing 14 filled with propellant or powder 16 and primer 18 (a stainless steel cup contacting propellant 16). Striking primer 18 with sufficient force ignites propellant 16. Casing 14 has a rim 20 at proximal end 22 followed by extractor groove 24. At distal end 26, casing 14 angles inward at an angle of 30 degrees to reduce the diameter of casing 14 to support bullet 12. The angled section is known as shoulder 28 which ends at neck 30 of cartridge 10 and the angle is referred to as the shoulder angle. Bullet 12 is inserted into cartridge 10 at mouth 32 and supported in cartridge 10 by neck 30. As previously discussed, the water weight volume is determined by filling cartridge 10 up to base 34 of neck 22. The bore diameter is determined by measuring the diameter 36 of bullet 12.

The cartridges of the present invention have a bore diameter of 0.510 inches to accept a 50 caliber bullet. The cartridges have a 30 degree shoulder angle on case 12 to create a positive head space on cartridge 10. The shoulder angle may be altered to allow easier feeding in a machine gun. A smaller shoulder angle would allow easier feeding.

Figure 2:
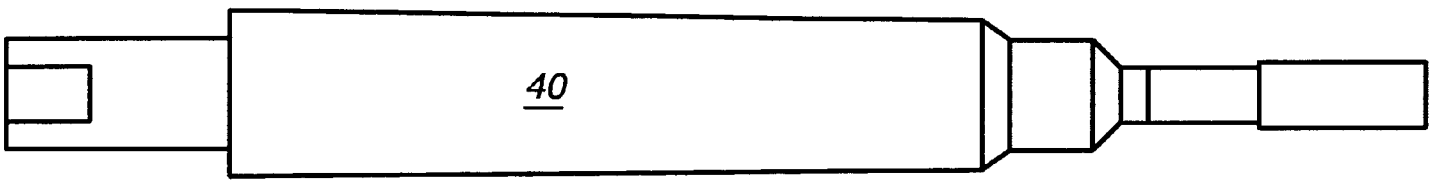
FIG. 2 is a side view of the chamber reamer associated with the gun cartridge shown in FIG. 1.

Once the measurements of cartridge 10 are determined using the efficiency ratio to provide cartridge 10 with an efficiency ration, preferably between 110 and 145. When the water weight volume is measured in grains, the bore diameter is measured in thousandths of inches and the bullet weight is measured in grains, corresponding reamer 40 (depicted in FIG. 2) is constructed in order to machine the barrel of a gun to create a chamber for cartridge 10. Any skilled gunsmith is capable of constructing the corresponding reamer and configuring the desired weapon to accommodate cartridge 10.

The embodiments disclosed herein are divided into two categories. The first three are shorter cartridges for use with short-range infantry support weapons, with barrel lengths of 18–22", bullet weight 500 grains, and maximum effective range 800 yards. The second are three longer cartridges for use with long-range sniper weapons, with barrel lengths of 26–28", bullet weight 650 grains, and maximum effective range of 2500 yards.

Case Dimensions

| | Short Range | | |
|---|---|---|---|
| | 1.5" | 1.75" | 1.90" |
| Case head size | 0.688" | 0.688" | 0.688" |
| Overall case length | 1.50" | 1.75" | 1.90" |
| Overall cartridge length | 3" | 3.25" | 3.40" |
| | Long Range | | |
| | 2.15" | 2.3" | 2.35" |
| Case head size | 0.688" | 0.688" | 0.688" |
| Overall case length | 2.15" | 2.3" | 2.35" |
| Overall cartridge length | 3.65" | 3.80" | 3.85" |

Of the cartridge embodiments, the 1.9" cartridge is the preferred shorter range cartridge as it provides the maximum velocity, and maximum power with the shortest cartridge. The 2.35" cartridge is the preferred long range cartridge as it provides the maximum power in a cartridge that fits in standard hunting magazines.

Both the short range and the long range cartridges are built from a modified .577 Tyrannosaur case. The .577 Tyrannosaur case is shortened and the shoulder angle is changed to 30 degrees to produce case 14. Modifying an existing case is preferred when producing small lots of cartridges since it avoids the tooling requirements and costs needed to manufacture a custom cartridge. When manufacturing large numbers of cartridges, custom cases may be manufactured with different case dimensions as long as the case is designed using the efficiency ratio to result in a cartridge with an efficiency between 110 and 145.

Efficiency Ratings of The Preferred Cartridge Embodiments

| 50 Caliber Cartridges | | | | |
|---|---|---|---|---|
| Case | Case Capacity Measured by Water Weight (grains) | × Bore (thousandths of inches) | /Bullet Weight (grains) | = Efficiency Rating |
| 1.5" | | | | |
| | 87.46 | 510 | 750 | 59.47 |
| | 87.46 | 510 | 650 | 68.62 |
| | 87.46 | 510 | 550 | 81.10 |
| | 87.46 | 510 | 500 | 89.21 |
| 1.75" | | | | |
| | 102.05 | 510 | 650 | 80.07 |
| | 102.05 | 510 | 550 | 94.63 |
| | 102.05 | 510 | 500 | 104.09 |
| 1.9" | | | | |
| | 139.5 | 510 | 650 | 109.45 |
| | 139.5 | 510 | 550 | 129.35 |
| | 139.5 | 510 | 500 | 142.29 |
| 2.15" | | | | |
| | 161.67 | 510 | 750 | 109.94 |
| | 161.67 | 510 | 650 | 126.85 |
| | 161.67 | 510 | 550 | 149.91 |
| | 161.67 | 510 | 500 | 164.90 |
| 2.3" | | | | |
| | 174.92 | 510 | 750 | 116.95 |
| | 174.92 | 510 | 650 | 137.24 |
| | 174.92 | 510 | 550 | 162.20 |
| 2.35" | | | | |
| | 181.67 | 510 | 750 | 123.54 |
| | 181.67 | 510 | 650 | 142.54 |
| 2.5" | | | | |
| | 196.17 | 510 | 750 | 133.40 |
| | 196.17 | 510 | 650 | 153.92 |
| Alternate Embodiment | | | | |
| | 156.67 | 510 | 650 | 122.98 |
| | 156.67 | 510 | 550 | 145.25 |
| Prior Art 50 BMG | | | | |
| | 298.20 | 510 | 750 | 202.78 |
| | 298.20 | 510 | 650 | 233.97 |

NOTE:
7000 grains = 1 lb.
Most efficient cartridges are highlighted

The cartridges of the present invention fulfill a need expressed by various law enforcement and military personnel for a small weapon with the power of a 50 caliber plus second and third shot capability. It had to be mobile and light enough to carry. In these times of military spending cuts it could not require a great amount of money to develop and manufacture.

1.5" Cartridge—This cartridge is subsonic. It has the capability of great accuracy in a rather small rifle with a 20" barrel. The barrel would have to be suppressed to muzzle the noise of the discharge of the cartridge. But the small cartridge in a very small rifle would be an ideal sniper-style weapon that could be easily concealed and lightweight. Its weight would be 10 lbs. or less, with extremely light recoil even using a 650 grain bullet. The cartridge would be efficient out to 300+ yards with a 650 or 750 grain bullet, if desired. Subsonic speeds of 1100 fps or less would have virtually no muzzle flash. If more power was needed out of a small cartridge, 1600 fps would be no difficulty for this cartridge due to its powder capacity of 75 to 80 grains of powder. This cartridge would be desirable for the marksman who does not want to be detected.

1.75" and 1.90" Cartridges—These cartridges are useful for battlefield weapons, similar to the AK47 (7.62×39), which was designed to be effective in a battle situation which usually takes place at less than 300 yds. The Russians designed the 7.62×39 to be a short-range cartridge that would be very effective in jungle or heavy brush. Long-range capability was not needed in most battle settings. The 7.62×39 was designed with a fairly large bore diameter of .311 (7.62 mm) on a rather short case of 39 mm in length. Using a 125 grain steel-core bullet the Russians found that in normal battle situations of 100 to 200 yds, the cartridge had enough power to go through car doors and heavy sheet metal, which was all that was needed for a soldier's weapon. Muzzle velocity was 2150 fps with 1200 ft-lbs. of muzzle energy in a 20" barreled machine gun. Over fifty million of these rifles have been produced to date in almost every Communist country.

Using the 650 grain bullet a rifle would be capable of 2100 fps in a 20" barrel, with muzzle energy of over 6000 ft-lbs. With a 500 grain bullet at 2300+ fps in the same barrel muzzle energy would be an impressive 6500 ft-lbs. This would give the foot soldier an unbelievably powerful rifle that could stop armored personnel vehicles, disable trucks, cars and aircraft on runways by damaging the engine blocks out to 500 yds. Yet it would still be efficient out to 800 yards. At that range it would still have over 2500 ft-lbs. of muzzle energy. The rifles could be made on a semi-auto or bolt action, or could be adapted to small machine guns or as door-mounted machine guns in helicopters to give troops cover. This would be a force multiplier to any squad or platoon. It would greatly increase the group's firepower without adding extra personnel. In addition, the rifle would still be capable of 1000 yd. sniper shots. This cartridge could be made, if so desired, on a Mauser-style bolt action rifle already in existence.

2.15" Cartridge—This cartridge has the same powder capacity as the alternate embodiment discussed below, but overall length would be 1" shorter allowing it to feed through the magazine of a bolt action Mauser rifle. The cartridge will hold 135 grains of powder, have a muzzle velocity of 2600 fps and muzzle energy of 10,000+ ft-lbs. from a 28" barrel. It would easily have 1000 yd. capability for sniping and be able to take out armored vehicles out to 600 yds. The cartridge could also be loaded with a 500 grain steel-core bullet with a muzzle velocity of 2800 fps, which would reduce recoil yet still maintain the power level necessary to take out armored vehicles and troop carriers.

The target velocity for this cartridge is 2500 fps because the most-used 1000 yard military target cartridge is the .308 Winchester (7.62 NATO), which shoot 168 grain match grade bullets at 2450 to 2550 fps muzzle velocity. The alternate embodiment cartridge, with its 2600+ fps muzzle velocity, not only duplicates the 308's velocity but exceeds it. The 2.15" has the same powder capacity as the alternate embodiment but is more than an inch shorter in overall cartridge length. This makes it adaptable to a magazine style rifle so it can be a repeater.

2.3" and 2.35" Cartridges—The 2.3" provides higher velocity with the 650 grain bullet, which would duplicate the 50 BMG in a 28" barrel. Muzzle velocity with the 650 grain bullet would be 2800 to 2850 fps and would still be adaptable to short-action machine guns. The rifle would have muzzle energy of over 12,000+ ft-lbs.

The 2.35" cartridge has optimum powder capacity in a Mauser-style bolt action rifle. The overall cartridge length would be 3.85", which would still allow it to feed in a Mauser-style magazine with a length of 3.9". It would have muzzle velocity of 2900 fps with a 650 grain steel-core bullet, and muzzle energy of 13,000+ ft-lbs. Even with this much power the rifle would still have half the muzzle flash of a 50 caliber BMG and twice the barrel life, and do it using 100 grains less powder than the 50 BMG case can hold.

The 2.35" has a muzzle velocity exceeding 2900 fps with a 650 grain bullet and 2700 fps with a 750 grain bullet. This cartridge would duplicate the muzzle velocity of the original 50 BMG (which used a 46" barrel), but in a rifle having a 28" barrel. A rifleman armed with a 50 caliber rifle and the 2.35" cartridge of the present invention, could easily hit parked enemy vehicles out to 9000 ft., nearly two miles away. With a good spotter and scope to watch for impacts and make proper adjustments, the rifleman could easily score hits on engines and cockpits on parked planes on runways. This cartridge has the capability of penetrating five houses. It capable of penetrating 10" of solid concrete or 2" of solid steel.

2.5" Cartridge—This cartridge is outside the preferred length range and thus is not as practical as the preceding cartridges. It can efficiently exceed the 3000 fps muzzle velocity with a 650 grain bullet. However, it would be strictly a single-shot cartridge because its overall length is 4". An action would need to be designed around the cartridge to make it a repeater, or a 3.9" magazine could be altered to accept it.

Alternate embodiment—The alternate embodiment provides the ability to change an already existing rifle that an individual owns or could afford to buy into a 50 caliber rifle of single shot design. This cartridge is also adapted to any military or law enforcement application using rifles on hand without the requirement of purchasing a complete new gun. A simple barrel installation and bolt-face alteration would be required. A .308 Win. (7.62 NATO) or a .300 Winchester Magnum rifle, which are the two most common cartridges for sniper use in the world, could be easily adapted to this cartridge.

Comparisons:

| | 7.62 NATO | .300 Win. Mag. | Present Invention |
|---|---|---|---|
| Bullet weight | 168 grains | 168 grains | 650 grains |
| Barrel length | 28" | 28" | 28" |
| Muzzle velocity | 2550 fps | 3050 fps | 2600 fps |
| Muzzle energy | 2600 ft-lbs | 3500 ft-lbs | 10,500 ft-lbs |

An alternate embodiment uses a 460 Weatherby case (a belted magnum). The 460 Weatherby case is a 45 caliber to begin with and holds approximately 120 grains of powder.

Case dimensions—compared to the 50 BMG:

| | 50 BMG | Alternate Embodiment |
|---|---|---|
| Case head size | 0.804" | 0.603" |
| Overall length of case | 3.910" | 2.900" |
| Overall cartridge length | 5.450" | 4.400" |

By opening the case neck and pushing the shoulder of the Weatherby case forward by 1/10" the resized case now holds approximately 125 grains of powder (estimated). A reamer is required that is custom-built to these specifications. A standard Ruger No. 1 hunting rifle, originally chambered for .45–70 Gov., and rebarreled it to 50 caliber can be used with the custom reamer, the Ruger is rechambered for the 50 caliber.

The cartridges of the present invention give the foot-soldier mobility. He can carry a rifle 5 times as powerful as what is normally carried into the battlefield. It provides confidence to the troops knowing that the firepower is readily available when needed. It allows a sniper to retain his invisibility because of the minimal light signature, which is due to the virtual elimination of muzzle flash. Also, the weapons' useful life would increase greatly, which is very cost-effective for the military or law enforcement.

Law enforcement has always had a concern about over-penetration. The shorter cartridges would be adaptable for law enforcement use because the 1.75" and 1.90" cartridges would still have the power of a 50 caliber, but would not over-penetrate. The law enforcement application is easily adapted to use disintegrating bullets to eliminate ricochets.

The present invention revolutionizes military small arms. It turns light infantry weapons into light heavy weapons. The weapon is "Light" since it can be carried and fired by an individual. But, the weapon is "Heavy" since it has 5 times the firepower of a normal shoulder-fired weapon. The cartridge can be constructed from components that are all readily available. Being able to convert existing weapons already in use, or to build new ones based on existing models, to use bullets or projectiles already in use, eliminates major retooling making this a practical and economical choice for military or law enforcement procurement.

From the above description, it will be apparent that the invention disclosed herein provides a novel and advantageous gun cartridge. The foregoing discussion discloses and describes merely exemplary methods and embodiments of the present invention. One skilled in the art will readily recognize from such discussion that various changes, modifications and variations may be made therein without departing from the spirit and scope of the invention. Accordingly, disclosure of the present invention is intended to be illustrative, but not limiting, of the scope of the invention, which is set forth in the following claims.

We claim:

1. An efficient 50 caliber gun cartridge having a proximal and distal end for propelling a projectile comprising:

a rimless cylindrical casing having a diameter of approximately 0.688 inches at the distal end and a shoulder at the proximal end angling inward at an angle of approximately 30 degrees as a means to allow easier feeding in a machine gun;

propellant contained in said cylindrical casing;

a primer mounted on said cylindrical casing; and a neck portion extending distally from the shoulder wherein said neck portion has a mouth for accepting a projectile having a bore diameter of approximately 0.510 inches;

wherein said casing has a length ranging from 1.75 inches to 2.5 inches measured from the primer to the mouth of said neck; and wherein said length of said casing is dependant upon water weight volume of said casing, said bore diameter of said mouth, and weight of the projectile.

2. The efficient 50 caliber gun cartridge of claim 1, wherein said cartridge with said projectile has a maximum length of 4.0 inches.

3. The efficient 50 caliber gun cartridge of claim 1, wherein said water weight of said casing in grains multiplied by said bore diameter of said mouth in thousandths of an inch divided by said weight of the projectile in grains is greater than or equal to 110 and less than or equal to 145.

4. An efficient 50 caliber gun cartridge having a proximal and distal end for propelling a bullet of a pre-determined weight comprising:

a cylindrical casing having a diameter of approximately 0.688 inches at the distal end and a shoulder at the proximal end angling inward at an angle of approximately 30 degrees;

propellant contained in the casing;

a primer mounted on the casing; and a neck portion extending distally from the shoulder wherein the neck portion has a mouth with a bore diameter of approximately 0.510 inches for accepting the bullet;

wherein the casing has a length ranging from 1.75 inches to 2.5 inches measured from the primer to the mouth; and wherein the length of the casing is dependant upon water weight volume of the casing, the bore diameter of the gun barrel, and the weight of the bullet.

5. The gun cartridge recited in claim 4, wherein the water weight of the casing in grains multiplied by the bore diameter of the mouth in thousandths of an inch divided by the weight of the bullet in grains is greater than or equal to 110 and less than or equal to 145.

6. The gun cartridge recited in claim 5, wherein the cartridge with the bullet has a maximum length of 4.0 inches.

7. An efficient 50 caliber gun cartridge having a proximal and distal end for propelling a bullet of a pre-determined weight comprising:

a cylindrical casing having a diameter of approximately 0.688 inches at the distal end and a shoulder at the proximal end angling inward at an angle of approximately 30 degrees;

propellant contained in the cylindrical casing;

a primer mounted on the cylindrical casing; and a neck portion extending distally from the shoulder wherein the neck portion has a mouth with a bore diameter of approximately 0.510 inches for accepting the bullet;

wherein the casing has a length ranging from 1.75 inches to 2.5 inches measured from the primer to the mouth; and wherein water weight of the casing in grains multiplied by the bore diameter of the mouth in thousandths of an inch divided by the weight of the bullet in grains is greater than or equal to 110 and less than or equal to 145.

8. The gun cartridge recited in claim 7, wherein the cartridge with the bullet has a maximum length of 4.0 inches.

* * * * *